US009490573B2

(12) United States Patent
Chien et al.

(10) Patent No.: US 9,490,573 B2
(45) Date of Patent: Nov. 8, 2016

(54) ELECTRICAL PLUG CONNECTOR WITH DOUBLE CASING

(71) Applicant: Chant Sincere Co., Ltd., New Taipei (TW)

(72) Inventors: Yu Chin Chien, New Taipei (TW); Chun-Hsiang Hsu, New Taipei (TW); Yong-Sheng Lin, New Taipei (TW)

(73) Assignee: CHANT SINCERE CO., LTD. (TW)

( * ) Notice: Subject to any disclaimer, the term of this patent is extended or adjusted under 35 U.S.C. 154(b) by 0 days.

(21) Appl. No.: 14/640,067

(22) Filed: Mar. 6, 2015

(65) Prior Publication Data

US 2015/0255917 A1 Sep. 10, 2015

(30) Foreign Application Priority Data

Mar. 7, 2014 (TW) ..... 103203969 U

(51) Int. Cl.
*H01R 41/00* (2006.01)
*H01R 13/622* (2006.01)

(52) U.S. Cl.
CPC ..... *H01R 13/622* (2013.01)

(58) Field of Classification Search
CPC ..... H01R 13/622; H01R 13/623
USPC ..... 439/320
See application file for complete search history.

(56) References Cited

U.S. PATENT DOCUMENTS 3,582,862 A * 6/1971 Anderson ..... H01R 13/7197 333/182
5,795,188 A * 8/1998 Harwath ..... H01R 9/0524 439/583
6,994,579 B2 * 2/2006 Yokoigawa ..... H01R 13/625 439/311
7,134,894 B2 * 11/2006 Murphy ..... H01R 9/05 439/307
7,467,978 B2 * 12/2008 Sundermeier ..... H01R 9/031 439/320
7,491,081 B2 * 2/2009 Fehling ..... H01R 13/622 439/277
7,635,283 B1 * 12/2009 Islam ..... H01R 9/05 439/583
7,798,848 B2 * 9/2010 Islam ..... H01R 4/5075 439/578
7,845,979 B2 * 12/2010 Eriksien ..... H01R 13/506 439/578
7,850,472 B2 * 12/2010 Friedrich ..... H01R 13/506 439/256
7,857,661 B1 * 12/2010 Islam ..... H01R 9/0521 439/584
7,918,687 B2 * 4/2011 Paynter ..... H01R 9/0521 439/578
8,157,587 B2 * 4/2012 Paynter ..... H01R 4/5025 439/454
8,206,176 B2 * 6/2012 Islam ..... H01R 13/565 439/578
8,277,247 B2 * 10/2012 Paynter ..... H01R 9/0521 439/578
8,454,383 B2 * 6/2013 Paynter ..... H01R 9/0521 439/578
8,475,205 B2 * 7/2013 Ehret ..... H01R 9/05 439/578
8,480,430 B2 * 7/2013 Ehret ..... H01R 9/05 439/578

(Continued)

*Primary Examiner* — Tulsidas C Patel
*Assistant Examiner* — Peter G Leigh
(74) *Attorney, Agent, or Firm* — Bacon & Thomas, PLLC

(57) ABSTRACT

A plug connector suitable for connecting with a socket connector including a first internal screw thread is provided. The plug connector includes an internal casing having an inside space, a set of terminals disposed in said inside space, a sleeve tube and an external casing. The sleeve tube is fixed to said internal casing and includes an external hook. The external casing is movably covered to said internal casing and includes a first external screw thread, an internal hook and a concaved slot caving in the inner surface of the external casing facing to said internal casing. The internal hook forms one of walls of said concaved slot. The external hook is movably disposed in said concaved slot. When said socket connector screws to said plug connector, said external casing is pulled toward said socket connector, and said internal hook of said external casing contact said external hook of said sleeve tube.

5 Claims, 6 Drawing Sheets

(56) References Cited

U.S. PATENT DOCUMENTS 8,758,053 B2 * 6/2014 Paynter ..... H01R 4/5025 439/454
2003/0119358 A1 * 6/2003 Henningsen ..... H01R 24/564 439/578
2003/0186583 A1 * 10/2003 Yeh ..... H01R 9/0518 439/585
2005/0014410 A1 * 1/2005 Justice ..... H01R 13/6335 439/320
2005/0208812 A1 * 9/2005 Gaidosch ..... H01R 13/623 439/320
2007/0212937 A1 * 9/2007 Vaccaro ..... H01R 43/28 439/578
2010/0112855 A1 * 5/2010 Paynter ..... H01R 9/0521 439/584
2011/0008998 A1 * 1/2011 Low ..... H01R 9/0521 439/578
2012/0064764 A1 * 3/2012 Islam ..... H01R 9/0521 439/578
2012/0064767 A1 * 3/2012 Islam ..... H01R 9/0521 439/583
2012/0064768 A1 * 3/2012 Islam ..... H01R 9/0521 439/585
2014/0342593 A1 * 11/2014 Murphy ..... H01R 13/567 439/359
2015/0050827 A1 * 2/2015 Chang ..... H01R 27/00 439/312

* cited by examiner

ELECTRICAL PLUG CONNECTOR WITH DOUBLE CASING

CROSS-REFERENCE TO RELATED APPLICATIONS

This application claims the benefit of the filing date under 35 U.S.C. §119(a)-(d) of Taiwan Patent Applications No. 103203969 , filed Mar. 7, 2014.

BACKGROUND OF THE INVENTION

Field of the Invention

The present invention relates to a connector, and particularly to a plug connector.

Description of the Related Art

In general, a transmission cable and an electronic device are usually connected by a connector to transmit signals. The connector includes a plug connector, which is a male end, and a socket connector, which is a female end, for being connected with the plug connector. As to a prior plug connector, a casing of the plug connector is an integrally molded iron casing in which a the set of terminals is located, wherein conducting wires for signal transmission of the transmission cable are connected to the set of terminals in the iron casing by which the iron casing achieves electromagnetic shielding effect with respect to the set of terminals and the transmission cable. In addition, some plug connectors are injected with glue within the casing to achieve water-proof function.

Whereas, in the prior plug connector, it is very complicated to assemble the set of terminals and a transmission cable in an integrally-molded casing. Furthermore, after assembled, the assembled product needs to be transported to a glue-injection factory for the subsequent glue-injecting process, which consumes manpower and time cost.

SUMMARY OF THE INVENTION

The present invention provides a plug connector which is easily-assembled and provides excellent electromagnetic shielding and water-proof effect.

The present invention provides a plug connector suitable for connecting with a socket connector mainly comprising a first internal screw thread. The plug connector comprises an internal casing, a set of terminals, a sleeve tube and an external casing. The internal casing includes an inside space, a first end and a second end opposite to the first end. The set of terminals is located in the inside space. The sleeve tube is fixed on the second end and includes an external hook that extends toward the first end. The external casing, which is movably sleeved on the internal casing, comprises: a third end and a fourth end that opposite to the third end, a first external screw thread located in the third end, and an internal hook located in the fourth end, and a concaved slot located neighboring to the internal hook. The concaved slot is concaved on the inner surface of the external casing facing the outer surface of the internal casing, wherein the internal hook is on the walls of the concaved slot, and the external hook is movably received by the concaved slot. When the first internal screw thread of the socket connector is screwed into the first external screw thread of the plug connector, the external casing is pulled towards the socket connector such that the internal hook of the external casing contacts with the external hook of the sleeve tube.

According to an aspect of the present invention, the sleeve tube and the external casing are conductive.

According to an embodiment of the present invention, it further includes a transmission cable comprises: a plurality of first conducting wires covered by the isolating layer, and at least one second conducting wire which is exposed to the isolating layer wherein the first conducting wires pass through the sleeve tube and connects to the set of terminals, and the second conducting wire is contacted the sleeve tube.

According to an aspect of the present invention, it further includes a flexible ring that is disposed between the sleeve tube and transmission cable.

According to an aspect of the present invention, the second conducting wire which is extended from the sleeve tube and then is folded to insert into a gap between the flexible ring and the sleeve tube.

According to an aspect of the present invention, it further includes a retaining plug which is inserted into the second end of the internal casing, comprising a plurality of first holes and a plurality of second holes which are disposed along the extending direction of the set of the set of terminals and are connected with each other in which the plural set of terminals of the set of the set of terminals are disposed in the first holes of the retaining plug, the diameter of each first hole is larger than the diameter of each of the set of terminals, and the diameter of each set of terminals is larger than the diameter of each second hole.

According to an aspect of the present invention, the retaining plug is an insulator.

According to an aspect of the present invention, the internal casing includes a annular ring that is disposed in the first end, and the external diameter of the annular ring is larger than the internal diameter of the first screw thread of the external casing.

According to an aspect of the present invention, the internal casing includes a second external screw thread that is located in the second end, and the sleeve tube includes a second internal screw thread that corresponds to the second external screw thread; the sleeve tube is screwed into and fixed to the internal casing.

According to an aspect of the present invention, the internal casing includes an anti-rotation unit whose external diameter is larger than the internal diameter of the second internal screw thread.

Accordingly, in the present invention, the plug connector is assembled by, firstly, sleeving the sleeve tube on the transmission cable, sleeving the external casing on the internal casing, connecting the set of terminals to the transmission cable in the internal casing, and finally inserting the external hook of the sleeve tube into the internal hook of the external casing to complete the assembling of the plug connector. The present invention is appreciated that the above assembly is easier as compared to the prior plug connector which requires to assemble the set of terminals and the transmission cable within one integrally molded casing. Moreover, since the sleeve tube and the external casing are both conductive, the present invention provides better electro-magnetic shielding effect with respect to the set of terminals and the transmission cable. In addition, the present invention disposes a flexible ring between the sleeve tube and the transmission cable to achieve a water-proof function by which a manufacturer doesn't need to perform the glue injecting process within the casing to thus efficiently save cost and time. Since the second conducting wire is contacted with the sleeve tube, in a situation that the plug connector is being connected with the socket connector, thus, the sleeve tube is contacted with the external casing in such a manner that the second conducting wire is electrical conducted with the sleeve tube and the external casing to thus upgrade the electronic-magnetic shielding effect. Furthermore, the plug connector of the present invention, for purpose of acting as a stopper, is provided with the retaining plug located at the second end of the internal casing to avoid the detachment of the set of terminals.

DETAILED DESCRIPTION OF THE EMBODIMENT(S)

Figure 1:
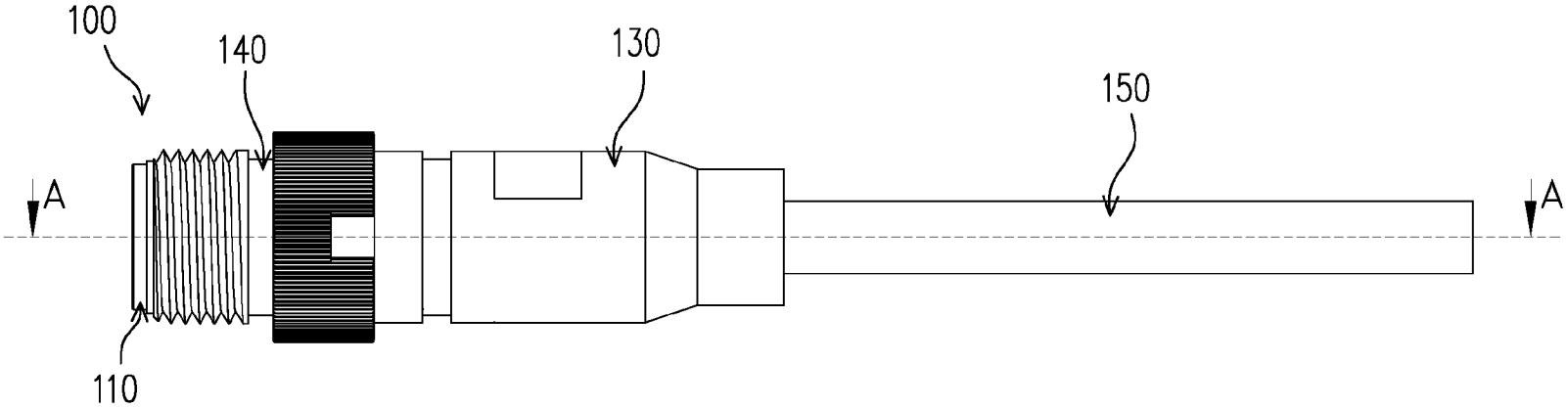
FIG. 1 is a prospective view a plug connector according to one embodiment of the present invention.
Figure 2:
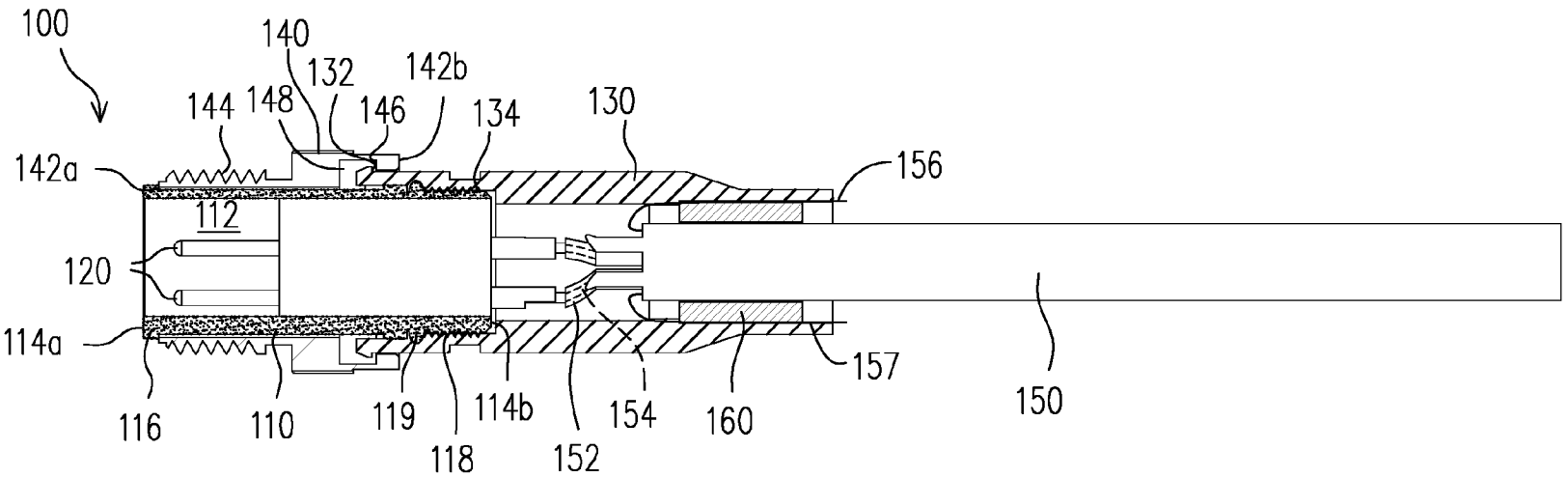
FIG. 2 is a cross-sectional view of the plug connector shown in FIG. 1.
Figure 3A:
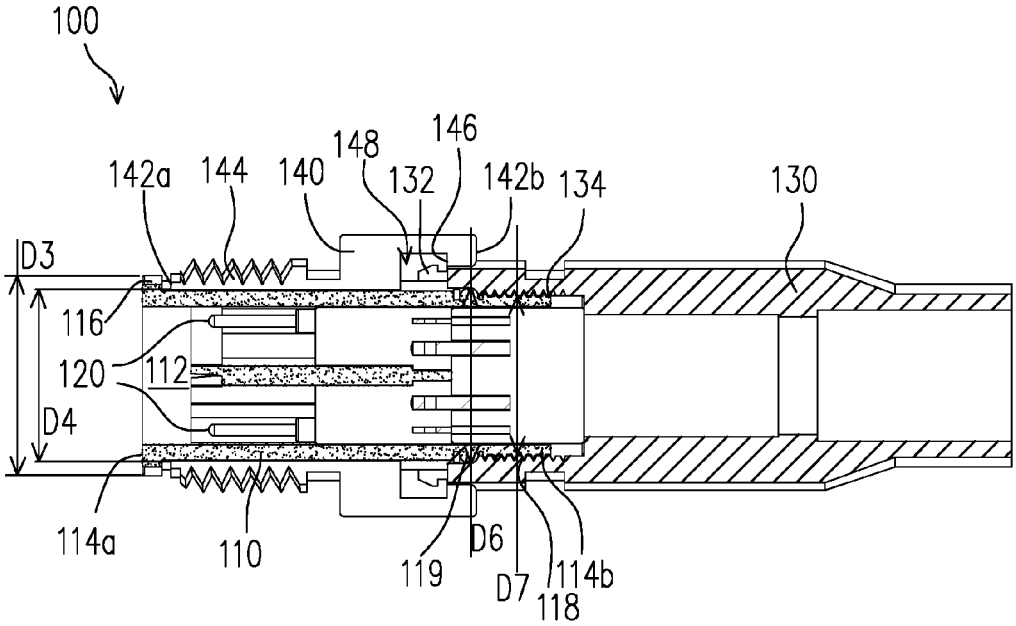
FIG. 3A is a cross-sectional view of the plug connector shown in FIG. 1 from another viewing angle without the set of the set of terminals and the flexible ring.
Figure 3B:
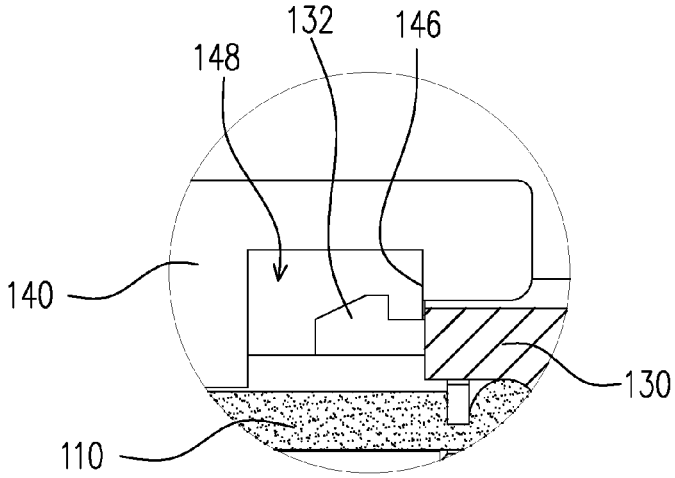
FIG. 3B is a partial enlargement view of FIG. 3A.

FIG. 1 is a prospective view of a plug connector according to one embodiment of the present invention. FIG. 2 is a cross-section view of the plug connector shown in FIG. 1. FIG. 3A is a cross-section view of the plug connector 100 shown in FIG. 1 from another viewing angle without the set of terminals and flexible ring. FIG. 3B is a partial enlargement view of FIG. 3A. Please refer to FIGS. 1 to 3B, which show that the plug connector 100 comprises an internal casing 110, a the set of terminals 120, a sleeve tube 130, an external casing 140, a transmission cable 150, and a flexible ring 160.

As shown in FIGS. 2 and 3A, the internal casing 110 comprises an inner space 112, a first end 114*a* and a second end 114*b* that are located on opposite sides, an annular ring 116 that is protruding from the first end 114*a* and a second external screw thread 118 that is located in the second end 114*b* . In this embodiment, the internal casing 110 is an insulator; the material of the internal casing is, for example, plastics, but not limited to this.

Figure 4A:
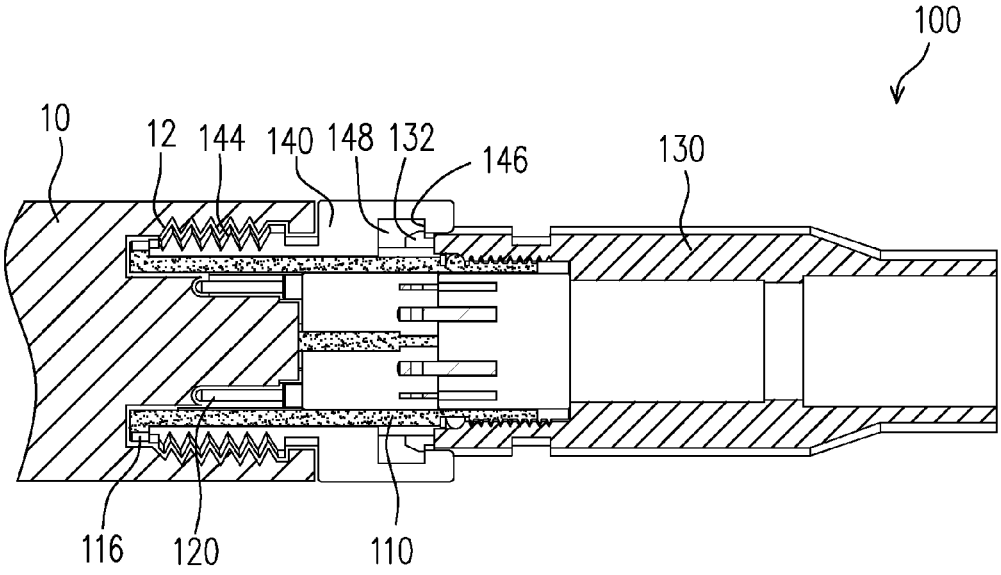
FIG. 4A is a cross-sectional view illustrating the socket connector being inserted to the plug connector of FIG. 3A.

The set of terminals 120 is disposed in the inner space 112, and in this embodiment, the set of terminals 120 appears from the first end 114*a* , which means the socket connector 10 for connecting with the plug connector 100 (as shown in FIG. 4A) is able to be plugged into the first end 114*a* from the internal casing 110 to connect with the set of terminals 120 to transmit the signal.

The sleeve tube 130 comprises an external hook 132 that extends toward the direction of the first end 114*a* and an second internal screw thread 134 that corresponds to the second external screw thread 118, the external hook 132 and the second internal screw thread 134 are located in the end of the sleeve tube 130 near the internal casing 110. In this embodiment, the sleeve tube 130 is fixed to the second end 114*b* of the internal casing 110 by screwing the second internal screw thread 134 into the second external screw thread 118 of the internal casing 110. Of course, in other embodiments, the sleeve tube 130 is also able to be fixed to the second end 114*b* of the internal casing 110 by buckling or other methods.

In addition, to avoid the internal casing 110 over screwing into the sleeve tube 130 which also means that the internal casing 110 excessively screws towards the right of FIG. 2 or of FIG. 3A, the internal casing 110 further includes an anti-rotation unit 119 that is located next to the second external screw thread 118; the anti-rotation unit 119 has an external diameter D6 larger than the internal diameter D7 of the second internal screw thread 134. Therefore, after the second external second screw thread 118 in the internal casing 110 that is the furthest from the second end 114*b* (the second external screw thread 118 closest to the left of FIG. 2 or FIG. 3A) being screwed into the second internal screw thread 134 of the sleeve tube 130, if the internal casing 110 keeps being screwed, the anti-rotation unit 119 would be stuck on the side wall of the second internal screw thread 134 of the sleeve tube 130, and thus restrict the internal casing to move further towards the sleeve tube 130.

The external casing 140 movably sleeves the internal casing 110, and comprises a third end 142*a* and a fourth end 142*b* that are located on opposite sides, a first external screw thread 144 located in the third end 142*a* , an internal hook 146 located in the fourth end 142*b* and, a concaved slot 148 located next to the internal hook 146. In this embodiment, when the socket connector 10 connects to the plug connector 100, the third end 142*a* of the external casing 140 contacts with the socket connector 10, and the fourth end 142*b* is the end which is far from the socket connector 10. The concaved slot 148 is concaved on the surface of the external casing 140 that faces the surface of the internal casing 110, and the internal hook 146 is one of walls of the concaved slot 148. In this embodiment, the internal hook 146 is the right wall of the concaved slot 148 which is shown in FIG. 2 or FIG. 3A. The external hook 132 of the sleeve tube 130 is contained in the concaved slot 148, and in this embodiment, the width of the concaved slot 148 is larger than that of the external hook 132 of the sleeve tube 130, and thus, the external casing 140 is relatively movable with respect to the sleeve tube 130 towards left and right of the figure.

As shown in FIG. 2, the transmission cable 150 comprises a plurality of first conducting wires 154 which are covered by an isolating layer 152 and at least one second conducting wire 156 that appears outside the isolating layer 152. In this embodiment, the first conducting wires 154 are for signal transmitting; they pass through the sleeve tube 130 and then connect to the set of terminals 120. In this embodiment, the second conducting wire 156 is a grounding wire, and the transmission cable 150 includes a plurality of second conducting wires 156, but the number is not exclusive.

The flexible ring 160 is disposed between the sleeve tube 130 and the transmission cable 150; more precisely, the flexible ring 160 is located in the sleeve tube 130 far from the internal casing 110. In this embodiment, the flexible ring 160 is an O ring; its material could be flexible material such as rubber or silicone, rendering the flexible ring 160 to tightly seal the gap between the sleeve tube 130 and the transmission cable 150, and thus the flexible ring achieves water-proof effect. Manufacturers can choose the flexible ring 160 sized by public scale present in the market according to the internal size of the sleeve tube 130; thus to isolate fluid from the space enclosed by the internal casing 110, the external casing 140, the sleeve tube 130 and the flexible ring 160. In this embodiment the flexible ring 160 is disposed in the plug connector to replace the conventional glue injecting process, which effectively saves producing cost and time.

In addition, as shown in FIG. 2, in this embodiment, the grounding second conducting wires 156 pass through the flexible ring 160 in the sleeve tube 130 and then is folded to reach into the gap 157 between the flexible ring 160 and sleeve tube 130 to contact with the sleeve tube 130. In this embodiment, the sleeve tube 130 is made of metal, which makes the sleeve tube 130 conductive with the second conducting wire 156. Of course, in other embodiments, it is not necessary to fold the second conducting wire 156; after entering from the right end of the sleeve tube 130 shown in FIG. 2, the second conducting wire can directly be pinched by the flexible ring 160 and the sleeve tube 130; the disposition of the second conducting wire 156 in the sleeve tube 130 is unlimited, as long as the second conducting wire 156 contacts with the sleeve tube 130.

The socket connector 10 is connected with the plug connector 100 of this embodiment, making the device conductive from the set of terminals 120; the relative position between the socket connector 10 and plug connector 100 is able to be maintained by screw connection after they are bolted. Through this screw connection of the two-pieces external casing 140 and sleeve tube 130, the plug connector 100 in this embodiment is able to build electro-magnetic shielding effect with respect to the internal the set of terminals 120 and the transmission cable 150. The detail is described below.

Figure 4B:
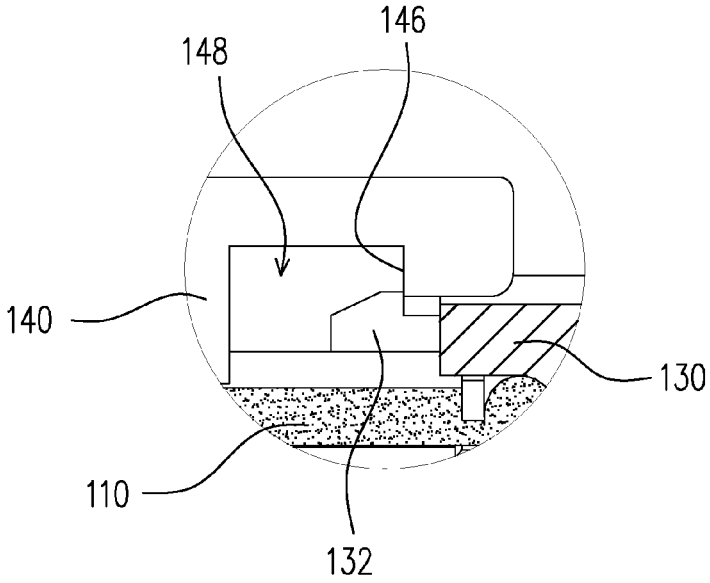
FIG. 4B is a partial enlargement view of FIG. 4A

FIG. 4A is cross-section scheme of the plug connector 100 bolted to the socket connector 10, which is shown in FIG. 3A. FIG. 4B is partial enlargement view of FIG. 4A. Please refer to FIGS. 4A and 4B, in this embodiment, the socket connector 10 comprises a first internal screw thread 12, and the external casing 140 comprises a first external screw thread 144 which corresponds to the first internal screw thread 12. In this embodiment, once the plug connector 100 and socket connector 10 are connected, the relative positions between them is able to be fixed by screwing the first internal screw thread 12 of the socket connector 10 into the first external screw thread 144 of the external casing 140 of the plug connector 100. More specifically, because the external casing 140 movably sleeves the internal casing 110, in the process of screwing the first internal screw thread 12 into the first external screw thread 144 of the plug connector 100, the external casing 140 is pulled toward the socket connector 10 (in the left of the figure) in relation to the sleeve tube 130 and the internal casing 110, making the concaved slot 148 of the external casing 140 move toward left, which makes the internal hook 146 of the external casing 140 contact with the external hook 132 of the sleeve tube 130. In this embodiment, the external casing 140 is made of metal, under this condition, the external casing 140 is electrically connected with the sleeve tube 130.

In this embodiment, because the grounding second conducting wire 156 (as shown in FIG. 2) contacts with the sleeve tube 130, and the external hook 132 of the sleeve tube 130 contacts with the internal hook 146 of the external casing 140, and the first external screw thread 144 of the external casing 140 contacts with the first internal screw thread 12 of the socket connector 10, the would-be grounding current goes through the second conducting wire 156, and then goes through the sleeve tube 130 and the external casing 140 to the socket connector 10. In this embodiment, the electro-magnetic shielding effect is effectively enhanced by grounding the sleeve tube 130 and the external casing 140.

In addition, to prevent the external casing 140 that sleeves the internal casing 110 from detaching easily, in this embodiment, by the disposition that the third end 142*a* in the third end of the external casing 140 is on the right-hand side of the annular ring 116 protruding from the first end 114*a* of the internal casing 110, and the external diameter D3 of the annular ring 116 is larger than the internal diameter D4 of the third end 142*a* of the external casing 140, the annular ring 116 can thus restricts the moving distance of the external casing 140 that is away from the sleeve tube 130 (in the left of the figure) to prevent the external casing 140 detaching from the internal casing 110.

Traditional plug connectors only comprise single iron case with tiny space which causes difficulties while assembling the set of terminals and transmission cable. In addition, the glue injecting process must be executed to achieve water-proof function, which increases the complexity of producing procedure. Compared with prior plug connectors, the plug connector 100 in this embodiment comprises two metal cases including the external casing 140 and the sleeve tube 130, and the assembly steps are: at first, plugging the flexible ring 160 into the sleeve tube 130, and make the sleeve tube 130 sleeve the transmission cable 150; make the external casing 140 sleeve on the internal casing 110; connecting the set of terminals 120 inside the internal casing 110 with the transmission cable 150; then screw the second external screw thread 118 of the internal casing 110 into the second internal screw thread 134 of the sleeve tube 130; finally, insert the external hook 132 of the sleeve tube 130 into the concaved slot 148 of the external casing 140, then the assembly is completed. The assembling procedure applied by the present invention is not only much simpler than that of the prior plug connectors, but also achieve excellent water-proof effect. The plug connector 100 in this embodiment has passed IP 67 dust and water proof test (remain operational in water at 1 meter deep for 40 minutes) in experiment.

Figure 5:
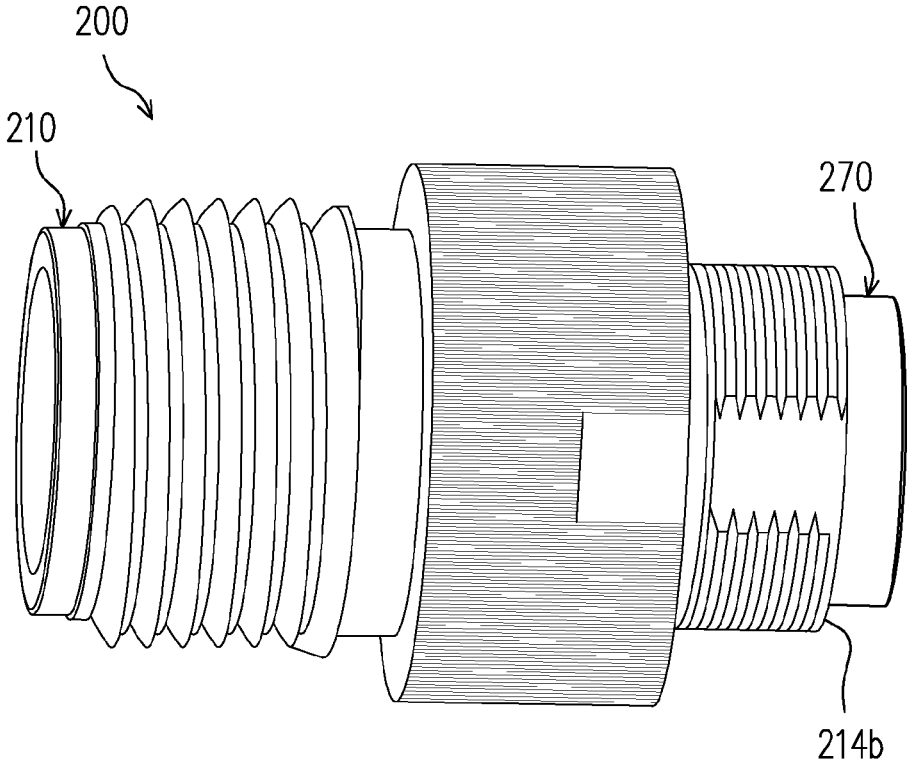
FIG. 5 is a partial schematic diagram of the plug connector according to another embodiment of the present invention.
Figure 6:
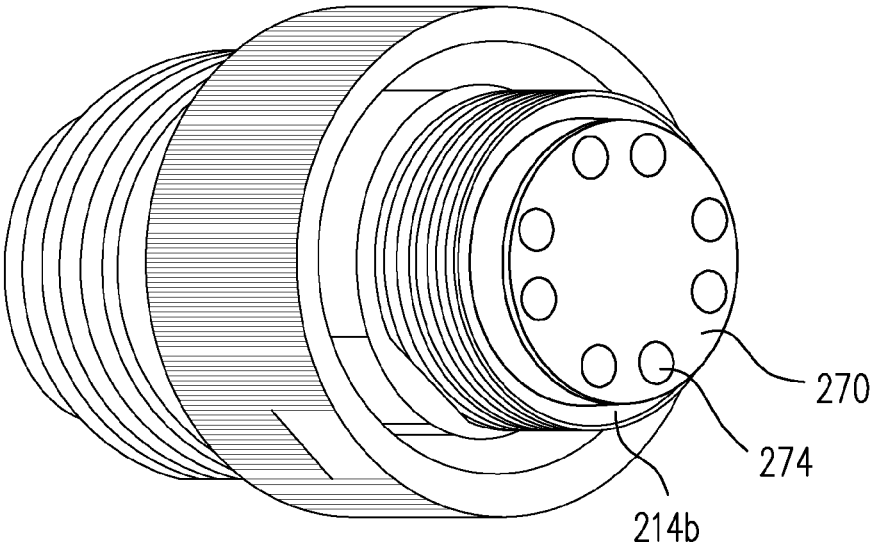
FIG. 6 is a schematic diagram of FIG. 5 from another viewing angle.
Figure 7:
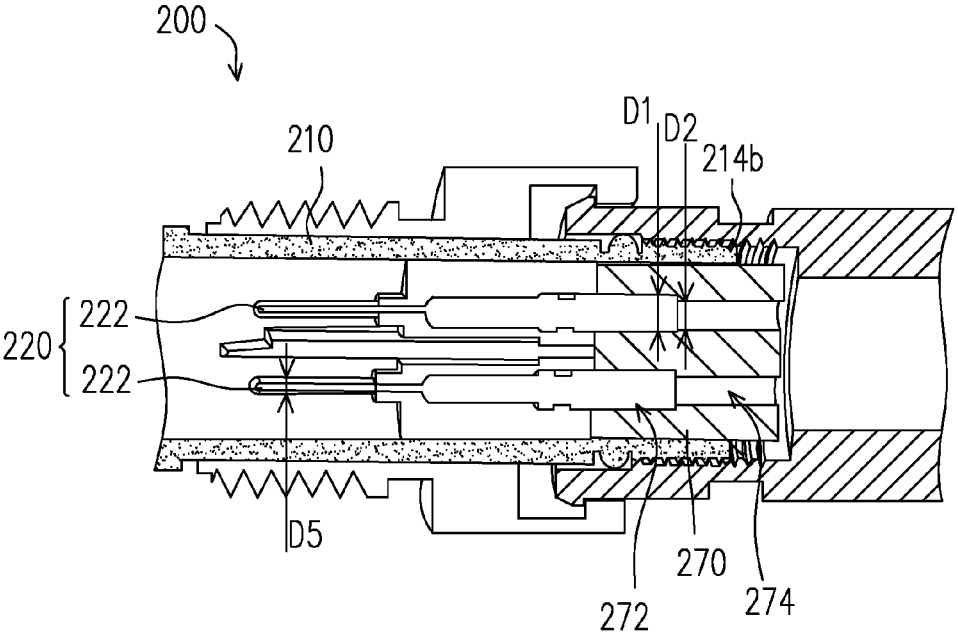
FIG. 7 is a cross-sectional diagram of the plug connector of FIG. 5 that is attached with the sleeve tube.

FIG. 5 is a partial schematic diagram of the plug connector of another embodiment of the present invention. FIG. 6 is a schematic diagram of FIG. 5 from another viewing angle. FIG. 7 is a cross-section view of the plug connector shown in FIG. 5 that has been attached with the sleeve tube. Please refer to FIGS. 5 to 7; the main difference between the plug connector 200 in this embodiment and the plug connector 100 of the last embodiment is that the plug connector 200 in this embodiment further comprises an electrically isolated retaining plug 270, which is inserted into the second end 214*b* of the internal casing 210.

As shown in FIG. 7, the retaining plug 270 comprises a plurality of first holes 272 and second holes 274 which are disposed along the extending direction of the set of terminals and are connected with each other; a plurality of the set of terminals 222 of the set of terminals 220 are contained in the first holes 272 of the retaining plug 270, and the diameter D1 of each first holes 272 is larger than the diameter D5 of the terminal 222, and the diameter D1 of each the first holes is larger than the diameter D2 each second holes 274. The first conducting wires of the transmission cable (not revealed in the Figures) is able to connect with the set of terminals 222 through the second holes 274. The plug connector 200 of this embodiment is able to prevent the detachment of the set of terminals 222 by contracting the passages between the first holes 272 and the second holes 274 on the retaining plug 270, which effectively restrain the position of the set of terminals 222.

To summarize the above, the plug connector revealed by the present invention could be assembled by, firstly, sleeving the sleeve tube on the transmission cable, sleeving the external casing on the internal casing, connecting the set of terminals to the transmission cable in the internal casing, and finally inserting the external hook of the sleeve tube into the internal hook of the external casing to complete the assembling of the plug connector. The present invention is appreciated that the above assembly is easier as compared to the prior plug connector which requires to assemble the set of terminals and the transmission cable within one integrally-molded casing. Moreover, since the sleeve tube and the external casing are both conductive, the present invention provides better electro-magnetic shielding effect with respect to the set of terminals and the transmission cable. In addition, the present invention disposes a flexible ring between the sleeve tube and the transmission cable to achieve a water-proof function by which a manufacturer doesn't need to perform the glue injecting process within the casing to thus efficiently save cost and time. Since the second conducting wire is contacted with the sleeve tube, in a situation that the plug connector is being connected with the socket connector, thus, the sleeve tube is contacted with the external casing in such a manner that the second conducting wire is electrical conducted with the sleeve tube and the external casing to thus upgrade the electronic-magnetic shielding effect. Furthermore, the plug connector of the present invention, for purpose of acting as a stopper, is provided with the retaining plug located at the second end of the internal casing to avoid the detachment of the set of terminals.

While the invention has been described in terms of various specific embodiments, those skilled in the art will recognize that the invention can be practiced with modification within the spirit and scope of the claims.

What is claimed is:

1. A plug connector suitable for connecting with a socket connector mainly configuring a first internal screw thread comprising:

an internal casing (110), said internal casing includes an inside space, a first end and a second end opposite to said first end;

a set of terminals (120), said set of terminals is located in said inside space;

a conductive sleeve tube (130), said sleeve tube is fixed on the second end and includes an external hook that extends toward said first end; and a conductive external casing (140), said external casing, which is movably sleeved on said internal casing, comprises: a third end and a fourth end that opposite to said third end, a first external screw thread located in said third end, and an internal hook located in said fourth end, and a concaved slot located neighboring to said internal hook, said concaved slot is concaved on the inner surface of the external casing facing the outer surface of said internal casing, wherein said internal hook (146) is on the walls of said concaved slot, and said external hook is movably received by said concaved slot;

when said first internal screw thread of said socket connector is screwed into said first external screw thread of said plug connector, said external casing is pulled towards said socket connector such that said internal hook of said external casing contacts with said external hook (132) of said sleeve tube;

wherein said plug connector further includes a transmission cable comprises: a plurality of first conducting wires covered by the isolating layer, and at least one second conducting wire which is exposed to the isolating layer wherein said first conducting wires pass through said sleeve tube and connects to said set of terminals, and the second conducting wire is contacted said sleeve tube;

wherein said plug connector further includes a flexible ring that is disposed between said sleeve tube and said transmission cable; and wherein said second conducting wire (156) which is extended from said sleeve tube and then is folded to insert into a gap (157) between the flexible ring (160) and said sleeve tube.

2. The plug connector of claim 1, wherein said plug connector further includes a retaining plug which is inserted into said second end of said internal casing, comprising a plurality of first holes and a plurality of second holes which are disposed along the extending direction of said set of terminals and are connected with each other in which said set of terminals are disposed in said first holes of said retaining plug, the diameter(D1)of each first hole is larger than the diameter (D5) of each terminal, and the diameter of each first holes is larger than the diameter (D2) of each second hole.

3. The plug connector of claim 2, wherein said retaining plug is an insulator.

4. A plug connector suitable for connecting with a socket connector mainly configuring a first internal screw thread comprising:

an internal casing (110), said internal casing includes an inside space, a first end and a second end opposite to said first end;

a set of terminals (120) said set of terminals is located in said inside space;

a sleeve tube (130), said sleeve tube is fixed on the second end and includes an external hook that extends toward said first end; and an external casing (140), said external casing, which is movably sleeved on said internal casing, comprises: a third end and a fourth end that opposite to said third end, a first external screw thread located in said third end, and an internal hook located in said fourth end, and a concaved slot located neighboring to said internal hook, said concaved slot is concaved on the inner surface of the external casing facing the outer surface of said internal casing, wherein said internal hook (146) is on the walls of said concaved slot, and said external hook is movably received by said concaved slot;

when said first internal screw thread of said socket connector is screwed into said first external screw thread of said plug connector, said external casing is pulled towards said socket connector such that said internal hook of said external casing contacts with said external hook (132) of said sleeve tube and;

wherein said internal casing includes an annular ring that is disposed in said first end, and said external diameter (D3) of said annular ring is larger than the internal diameter (D4) of said first screw thread of said external casing.

5. A plug connector suitable for connecting with a socket connector mainly configuring a first internal screw thread comprising:

an internal casing (110), said internal casing includes an inside space, a first end and a second end opposite to said first end;

a set of terminals (120), said set of terminals is located in said inside space;

a sleeve tube (130), said sleeve tube is fixed on the second end and includes an external hook that extends toward said first end; and an external casing (140), said external casing, which is movably sleeved on said internal casing, comprises: a third end and a fourth end that opposite to said third end, a first external screw thread located in said third end, and an internal hook located in said fourth end, and a concaved slot located neighboring to said internal hook, said concaved slot is concaved on the inner surface of the external casing facing the outer surface of said internal casing, wherein said internal hook (146) is on the walls of said concaved slot, and said external hook is movably received by said concaved slot;

when said first internal screw thread of said socket connector is screwed into said first external screw thread of said plug connector, said external casing is pulled towards said socket connector such that said internal hook of said external casing contacts with said external hook (132) of said sleeve tube and;

wherein said internal casing includes a second external screw thread that is located in said second end, and said sleeve tube includes a second internal screw thread that corresponds to said second external screw thread; said sleeve tube is screwed into and fixed to said internal casing; and wherein said internal casing includes an anti-rotation unit (119) whose external diameter(D6) is larger than the internal diameter(D7)of said second internal screw thread.

* * * * *